US009375615B2

(12) United States Patent
Park

(10) Patent No.: US 9,375,615 B2
(45) Date of Patent: Jun. 28, 2016

(54) GOLF PUTTER

(71) Applicant: Chung Yeul Park, Yongin-si (KR)

(72) Inventor: Chung Yeul Park, Yongin-si (KR)

( * ) Notice: Subject to any disclaimer, the term of this patent is extended or adjusted under 35 U.S.C. 154(b) by 0 days.

(21) Appl. No.: 14/483,594

(22) Filed: Sep. 11, 2014

(65) Prior Publication Data

US 2016/0051864 A1 Feb. 25, 2016

(30) Foreign Application Priority Data

Aug. 22, 2014 (KR) ..... 10-2014-0109435

(51) Int. Cl.
*A63B 53/04* (2015.01)
*A63B 53/02* (2015.01)

(52) U.S. Cl.
CPC ..... *A63B 53/02* (2013.01); *A63B 53/0487* (2013.01)

(58) Field of Classification Search
CPC ..... A63B 53/0487; A63B 69/3685; A63B 53/021; A63B 2053/0441; A63B 53/007; A63B 53/02; A63B 69/3632
USPC ..... 473/219, 238, 242, 251, 252, 253, 254, 473/268, 305, 314
See application file for complete search history.

(56) References Cited

U.S. PATENT DOCUMENTS 2,898,109 A * 8/1959 Williams ..... 473/240
2,926,913 A * 3/1960 Stecher ..... 473/314
3,033,574 A * 5/1962 Partridge ..... 473/251
D197,471 S * 2/1964 Handelan ..... D21/743
3,194,564 A * 7/1965 Swan ..... 473/236
D230,750 S * 3/1974 Ehrich ..... D21/736
3,876,211 A * 4/1975 Caligiuri ..... 473/253
4,325,550 A * 4/1982 Thompson et al. ..... 473/313
D275,217 S * 8/1984 Bernhardt ..... D21/743
4,508,350 A * 4/1985 Duclos ..... 473/254
D285,232 S * 8/1986 Collins ..... D21/744
4,629,193 A * 12/1986 Pierman ..... 473/254
4,629,195 A * 12/1986 Charney ..... 273/254
4,693,478 A * 9/1987 Long ..... 473/251
4,988,107 A * 1/1991 Sasse ..... 473/254
5,255,919 A * 10/1993 Johnson ..... 473/313
5,292,128 A * 3/1994 Solheim ..... 473/313
5,544,883 A * 8/1996 Meyer ..... 473/313
5,569,098 A * 10/1996 Klein ..... 473/300
5,816,930 A * 10/1998 Brown ..... 473/254
5,830,078 A * 11/1998 McMahan ..... 473/252
5,913,731 A * 6/1999 Westerman ..... 473/251
6,200,227 B1 * 3/2001 Sery ..... 473/251
6,261,190 B1 * 7/2001 Ashcraft ..... 473/251
6,270,422 B1 * 8/2001 Fisher ..... 473/223
6,379,259 B1 * 4/2002 Opie ..... 473/251
6,503,151 B2 * 1/2003 Kosovac ..... 473/244
6,554,720 B1 * 4/2003 Chambers et al. ..... 473/313
6,558,268 B2 * 5/2003 Tindale ..... 473/244
6,902,496 B2 * 6/2005 Solheim et al. ..... 473/341

(Continued)

*Primary Examiner* — William Pierce
(74) *Attorney, Agent, or Firm* — Bacon & Thomas, PLLC

(57) ABSTRACT

Disclosed herein is a golf putter including a putter head, a neck formed on a radial line of curvature of a central point of the putter head, spaced apart from an upper surface of a toe of the putter head, and integrally connected to a heel of the putter head, and a hosel formed at the neck to insert a putter shaft and configured such that a lower end extension line of the putter shaft is directed toward the central point of the putter head while being inclined toward a golfer's body with respect to a vertical line. An end line of the neck is located on a swing line, an upper surface of the neck is formed with a neck indication portion, and the putter head is formed with a putter head indication portion.

1 Claim, 8 Drawing Sheets

(56) References Cited

U.S. PATENT DOCUMENTS

| | | | | |
|---|---|---|---|---|
| 6,949,028 | B1 * | 9/2005 | Hueber | 473/242 |
| 7,101,288 | B2 * | 9/2006 | Thomas | 473/242 |
| 7,371,185 | B1 * | 5/2008 | Rohrer | 473/255 |
| 7,407,445 | B2 * | 8/2008 | Pedraza et al. | 473/314 |
| 7,857,710 | B2 * | 12/2010 | Pedraza | 473/313 |
| 8,740,718 | B1 * | 6/2014 | Farris et al. | 473/252 |
| 8,771,096 | B2 * | 7/2014 | Cameron | 473/244 |
| 8,771,098 | B2 * | 7/2014 | Hilton | 473/251 |
| 2004/0259655 | A1 * | 12/2004 | Ferris | 473/251 |
| 2009/0286612 | A1 * | 11/2009 | Pouliot et al. | 473/251 |

* cited by examiner

GOLF PUTTER

BACKGROUND OF THE INVENTION

1. Field of the Invention

The present invention relates to a golf putter, and more particularly to a golf putter capable of being swung in an accurate direction while having a face forming an accurate angle with a golf ball when a golfer strikes the golf ball on a green.

2. Description of the Related Art

A putter is a club used for golf and is used for the purpose of putting a golf ball into a hole by striking the golf ball placed on a green. In golf, the most important elements are accurate directional properties and force regulation.

In this case, a golfer should sensuously putt the golf ball by grasping characteristics such as a distance and line between the golf ball and a hole such that the golf ball rolls on the lawn of the green as if a wheel rolls. Thus, the golf ball is less affected by slight variations in the green surface.

When the putter impacts the ball, a head of the putter is preferably adapted to be square relative to a movement direction of the ball. The putter adapted to be square has to impact the ball such that a so-called sweet spot of the putter passes a center of the ball.

In putters developed to improve putting skill of golfers, a putter known to have heel-toe balance in which an engineering principle is introduced to the putter has been developed. Before such a development, most of putters were blade putters having a flat plate shape. In brief, in a putter designed according to a heel-toe balance principle, a heel and toe of a putter head have mass bodies. This enables the putter head to have an increased moment of inertia such that the putter may resist torsion generated when the golf ball is struck at a putter face point spaced apart from the sweet spot of the putter. The putter keeping the heel-toe balance has face balance which is another manufacturing characteristic. The putter having the face balance has the same one moment arm. This means that the mass bodies at the heel and the toe are located at the same distance from a rotary axis. This is configured by connecting a shaft of the putter to a center between the toe and the heel of the putter, namely, by connecting the shaft to be close to a center of gravity. U.S. Pat. No. 3,954,265 discloses a putter keeping face balance by another method. In this case, a shaft is attached to a putter head at a position close to a heel and is bent in a specific shape. A bent portion at the shaft is located at a lower end portion thereof.

As shown in FIGS. 1 and 2, a putter 10 includes a putter head 12 having a typical face 14 with which a golf ball is struck, a toe 16, and a heel 18. The putter 10 includes a hosel 20 having a specific shape to be described in detail later. Although not described in detail, it will be understood by one skilled in the art that a long shaft 22 has a lower end portion which is tightly fixed to an upper end portion of the hosel 20, the shaft 22 defines a vertical axis 24, and a typical grip 2 is mounted to an upper end of the shaft 22.

As is well known, every object has a center of gravity regarded as overall weight of the object being concentrated on one point. A center of gravity of the putter head 12 is indicated by a point CG. An imaginary line 26 perpendicular to the face 14 of the putter head 12 passes through the point CG and a spot 28 on the face 14 of the putter head. The spot 28 is a sweet spot of a golf club known in the art. When a swing path of the golf club, namely the putter 10 coincides with the imaginary line 26, the golf ball is impacted on the sweet spot 28 to generate maximum energy transfer, with the consequence that torsional force is not applied to the putter head. If the golf ball is impacted at a position away from the sweet spot 28, force of rotating the head about the vertical axis 24 of the shaft 22 is applied to the putter head 12. This undesired rotation of the putter head 12 may be restricted by inertia and the putter 10 has a shape for maximizing a moment of inertia.

As shown in FIG. 2, the putter head 12 includes a first mass concentration portion M1 at the toe 16 of the putter head 12 and a second mass concentration portion M2 at the heel 18 of the putter head. The moment of inertia of the object about any axis is defined by summing values obtained by multiplying the square of a distance from the axis and each mass. As in the putter 10, the heel-toe balance means that the concentration portions are located at the toe and the heel.

Another method of improving stability of the putter is face balance known in the art. The face balance is generated when each of the mass concentration portions M1 and M2 are located at the same distance from the vertical axis 24 of the shaft 22. The stability of the putter may be further improved when a distance from each axis of the mass concentration portions M1 and M2 is maximized within a possible range. The above objects are accomplished by the provision of the above-mentioned hosel 20 having a specific shape.

Referring to FIG. 1, the hosel 20 extends from a position close to the heel 18 of the putter head 12. The hosel 20 includes a vertical leg portion 30 having a bent upper end portion to form a cantilever arm 32 extending forward of the putter head 12. A socket protrusion portion 34 is formed at an extension end portion of the cantilever arm 32 and the lower end portion of the putter shaft 22 is fixed into the protrusion portion 34 as described above. The vertical leg portion 30 of the hosel 20 has a length determined such that the vertical axis 24 of the putter shaft 22 intersects the imaginary line 26 at a point 36. Accordingly, by the above-mentioned hosel 20 having a specific shape, the vertical axis 24 of the shaft 22 is located such that distances between the mass bodies M1 and M2 and the axis 24 indicated by respective imaginary lines 38 and 40 are equal to each other, and the putter will rotate about the axis 24 when the putter is struck at a position away from the spot. Particularly, the distances, which are caused by offsetting the intersection point 36 forward of the putter head 12 and are indicated by the imaginary lines 38 and 40, are maximized within an actual range. The stability of the putter head is achieved by forward location of the intersection point 36. Since the center of gravity CG is a point at which overall weight of the club head 12 is concentrated, the center of gravity CG will act as a mass concentration point.

The mass concentration portion cooperates with the distance between the center of gravity CG and the intersection point 36 and generates another moment of inertia for restricting torsion of the putter 10 due to striking of the putter at a position away from the spot.

However, in every case, the shaft 22 is obliquely coupled to the conventional putter 10 instead of being perpendicular to the ground. Thus, it may be possible to prevent movement (bending) of the wrist during a stroke (a stroke action of the ball) and to naturally send the ball to a target point by linking rotation motion of the spine to linear motion of the arm.

FIGS. 3 to 5 show that a golfer addresses the ball with the club in a state of taking a stance. During address of the ball, a known desirable posture is that, when the golfer looks down on the ball in a state in which the club head is parallel with the ground, a viewing line 7 joining the golfer's eye to the golf ball 6 is perpendicular to the ground, as shown in FIG. 4. The viewing line 7 as shown in FIG. 4 is away from the vertical state when the golfer's eye is located behind the golf ball 6 as shown in FIG. 3 or the golfer's eye is located in the front of the golf ball 6 as shown in FIG. 5. For this reason, when the ball is struck with such a posture, the ball is away from a target direction. The putter 10 has a defect which may not ascertain whether or not the viewing line 7 is vertical even though the putter head 12 is parallel with the ground. In other words, since it may not accurately ascertain whether the golfer's own eye is located in the front of the ball or behind the ball, the golfer performs putting depending upon a sensory feeling.

Golf is often referred to as a metal game. Uncertainty about golfer's own determination of whether the putter located at the ball accurately corresponds to the golfer's eye viewing the same during putting address of the ball will more increase stress of the golfer during putting on the green.

Accordingly, putters for accurately striking the ball by various methods, such as using a putter head provided with an indication line to ascertain an accurate direction or using a putter head provided with a leveler, have been developed. Korean Patent No. 10-1276686 filed by the present inventor discloses a putter for informing a golfer of a swing direction of a putter head. Hereinafter, the putter will be described.

As shown in FIG. 6, a conventional putter 50 includes a putter head 51 which has a plurality of horizontal protrusions 51*a* formed on a face surface for striking a golf ball at a sweet spot, an arc-shaped neck 52 which is formed on a radial line of curvature of a central point of the putter head 51, is spaced apart from an upper surface of a toe 51*b* as a front portion of the putter head 51, and is integrally connected to a heel 51*c* as a rear portion of the putter head 51, and a hosel 53 which is integrally formed with the neck 52 to insert a putter shaft 22 gripped by a golfer's hand and is configured such that a lower end extension line of the putter shaft 22 is directed toward the central point of the putter head 51 while being inclined toward a golfer's body with respect to a vertical line.

Accordingly, a line CGL passing a center of gravity of the putter head 12 is naturally located at the center of the putter head 12. The center line of gravity is indicated by reference numeral CGL and coincides with a swing line during putting.

When a swing path of the putter 50 coincides with the center line of gravity CGL, the golf ball is impacted on the sweet spot to generate maximum energy transfer, with the consequence that torsional force is not applied to the putter head. If the golf ball is impacted at a position away from the sweet spot, force of rotating the head about the hosel 53 is applied to the putter head 51. This undesired rotation of the putter head 51 may be restricted by inertia and the putter 50 has a shape for maximizing a moment of inertia.

The neck 52 extends forward of the hosel 53. Therefore, force, namely, kinetic energy generated by swing of the putter head 51 toward the heel 51*c* or the toe 51*b* during impact of the putter is distributed so that the putter head 51 is prevented from rotating.

In addition, the neck 52 has a neck groove 52*a* formed on an upper surface of the neck 52 coinciding with the vertical line of the central point of the putter head 51. The putter head 51 has a putter head groove 51*d* formed in a linear shape so as to coincide with the center line of gravity CGL as the swing line of the putter head 51 at a symmetric center between the heel 51*c* as the rear portion and the toe 51*b* as the front portions of the putter head 51.

As such, by forming the linear-shaped neck groove 52*a* and putter head groove 51*d* coinciding with the swing line of the putter head 51, the golfer putts the ball after visually ascertaining whether the two linear-shaped grooves 52*a* and 51*d* coincide with each other by the golfer's own eye during putting. When the two grooves do not coincide with each other, the golfer putts the ball in a state in which the putter head 51 is inclined in a forward and backward direction of the golfer with respect to the ground. Thus, the golfer may not send the ball along a desired putting line.

Here, the putter serves to prevent the putter head 51 from being putted in a state in which the putter head 51 is inclined in the forward and backward direction of the golfer with respect to the ground. However, the putter may not check a state in which the putter head 51 is inclined in the forward and backward direction of the golfer.

SUMMARY OF THE INVENTION

Therefore, the present invention has been made in view of the above problems, and it is an object of the present invention to provide a golf putter capable of allowing a face of a putter head to be accurately arranged in forward/backward and left/right directions with respect to a golf ball when the putter head is located at the ball for striking the ball.

In accordance with the present invention, the above and other objects can be accomplished by the provision of a golf putter including a putter head, a neck formed on a radial line of curvature of a central point of the putter head, spaced apart from an upper surface of a toe of the putter head, and integrally connected to a heel of the putter head, and a hosel formed at the neck to insert a putter shaft and configured such that a lower end extension line of the putter shaft is directed toward the central point of the putter head while being inclined toward a golfer's body with respect to a vertical line, wherein an end line of the neck is located on a swing line passing a central point of the putter head, an upper surface of the neck is formed with a neck indication portion extending in a direction of the heel from the end line of the neck, and the putter head is formed with a putter head indication portion extending in a direction of the toe from a vertical projection line of the end line of the neck projected to the putter head such that the neck indication portion coincides with a horizontal line and vertical line as imaginary lines.

Here, the horizontal line may coincide with a center line of gravity CGL which is the swing line of the putter head.

In a preferred embodiment of the present invention, the neck may have an arc shape.

In another embodiment of the present invention, the neck indication portion may have a "ㄴ" shape configured to have a vertical indication portion and a horizontal indication portion, an end line of the vertical indication portion may coincide with the end line of the neck, and the putter head may be additionally formed with a second putter head indication portion coinciding with a line of the horizontal indication portion.

The horizontal indication portion may serve to more visually and easily grasp a swing direction of the putter head disclosed in Korean Patent No. 10-1276686 by the present inventor.

In the present invention, each of the indication portions may be a groove and be indicated as a different color from a color of the putter head.

In accordance with the putter of the present invention, when a golfer arranges the putter to the ball, the putter head may be accurately arranged on the swing line of the putter. Consequently, it may be possible to perform accurate putting.

In addition, since the present invention provides one accurate reference capable of arranging the putter to the ball and the ground during address of the ball, it may be possible to help the golfer in putting the ball with confidence.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
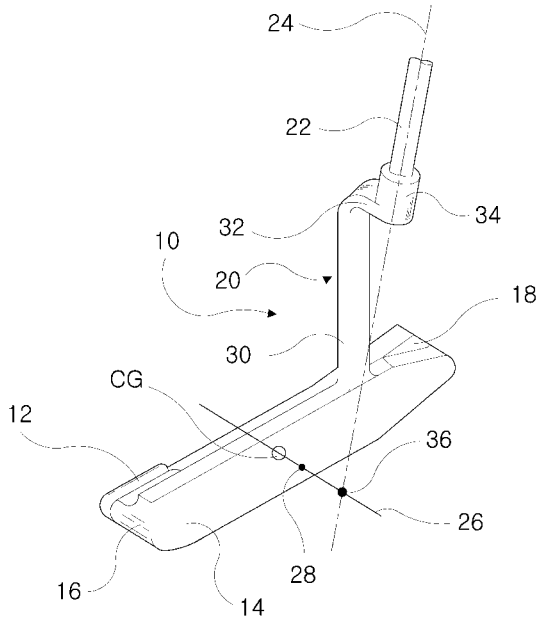
FIGS. 1 and 2 are perspective views illustrating a conventional putter.

Hereinafter, the present invention will be described in detail.

FIGS. 8 to 13 are views illustrating a putter according to an embodiment of the present invention. A putter 50 of the present invention includes a putter head 51 which has a plurality of horizontal protrusions 51*a* formed on a face surface for striking a golf ball 100 at a sweet spot, an arc-shaped neck 52 which is formed on a radial line of curvature of a central point of the putter head 51, is spaced apart from an upper surface of a toe 51*b* as a front portion of the putter head 51, and is integrally connected to a heel 51*c* as a rear portion of the putter head 51, and a hosel 53 which is integrally formed with the neck 52 to insert a shaft 22 and is configured such that a lower end extension line of the putter shaft 22 is directed toward the central point of the putter head 51 while being inclined toward a golfer's body with respect to a vertical line.

The putter head 51 is configured such that the heel 51*c* and the toe 51*b* have a symmetric shape with respect the center of the putter head 51.

Figure 2:
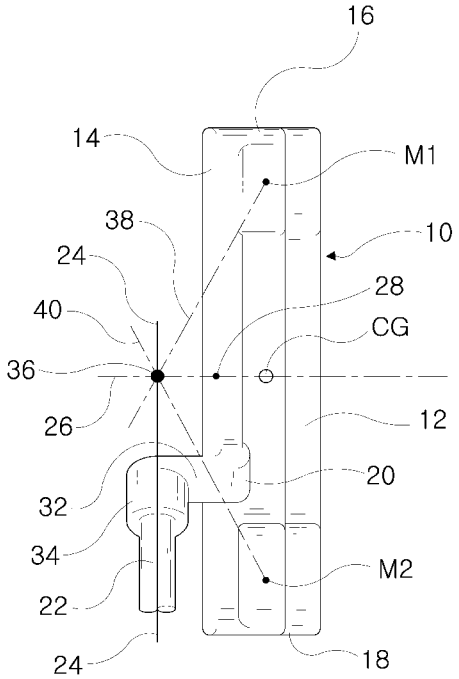
Figure 3:
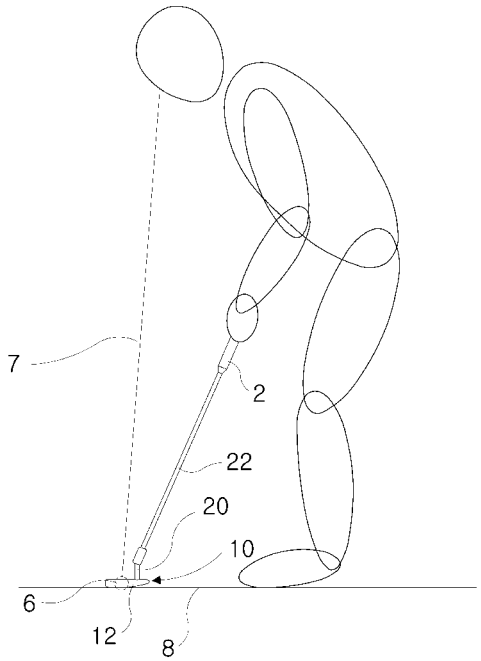
FIGS. 3 to 5 are views illustrating a use state of the conventional putter.
Figure 4:
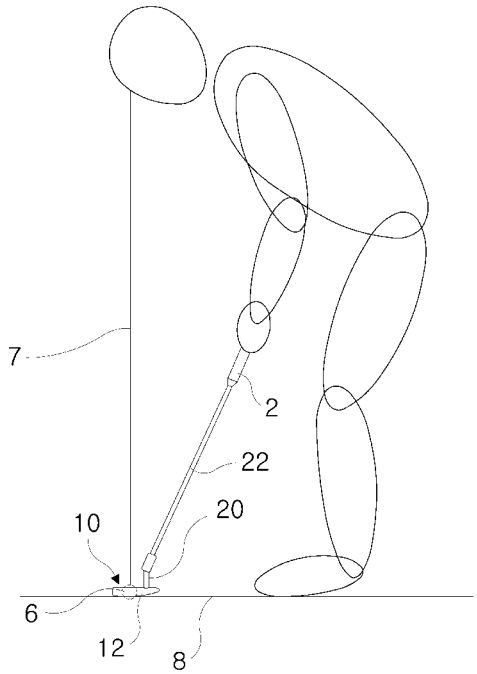
Figure 5:
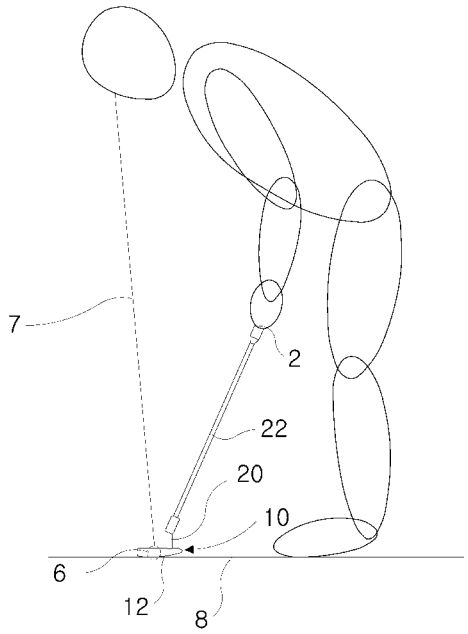
Figure 6:
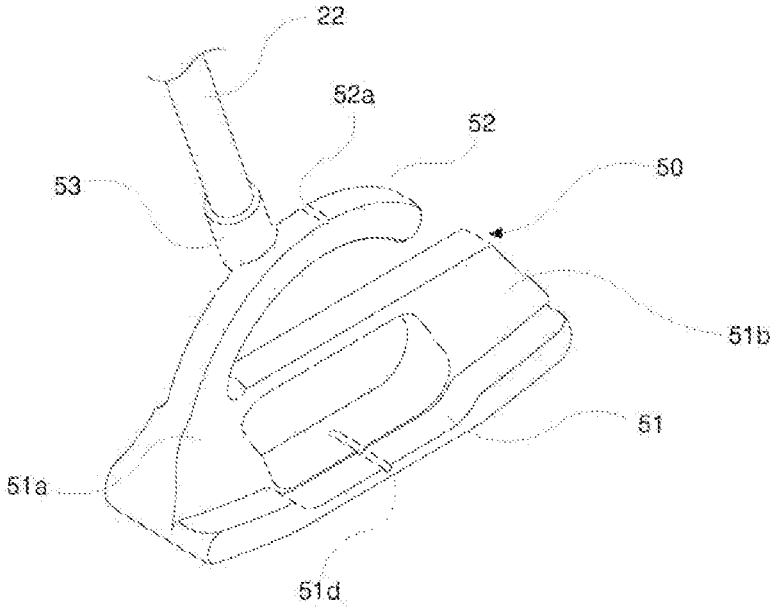
FIG. 6 is a perspective view illustrating a conventional putter.
Figure 7:
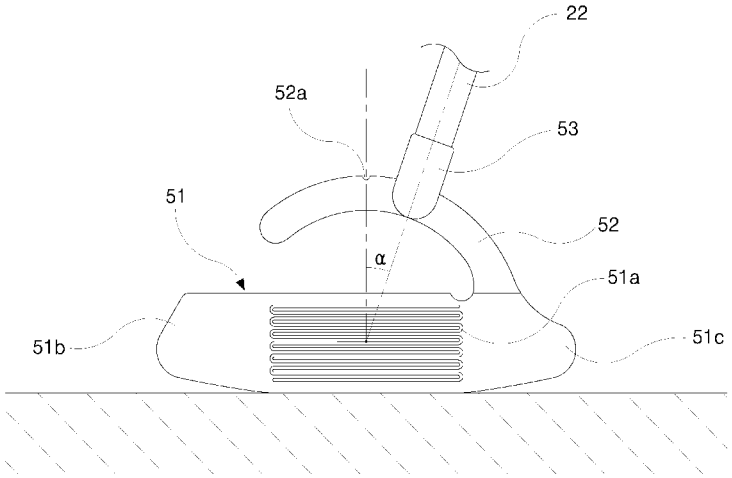
FIG. 7 is a side view illustrating the conventional putter.
Figure 8:
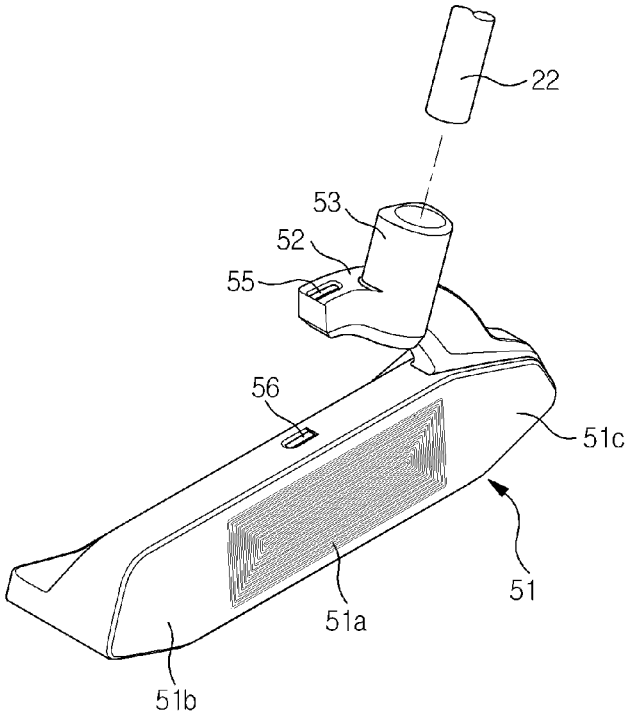
FIG. 8 is a perspective view illustrating a putter according to an embodiment of the present invention.
Figure 9:
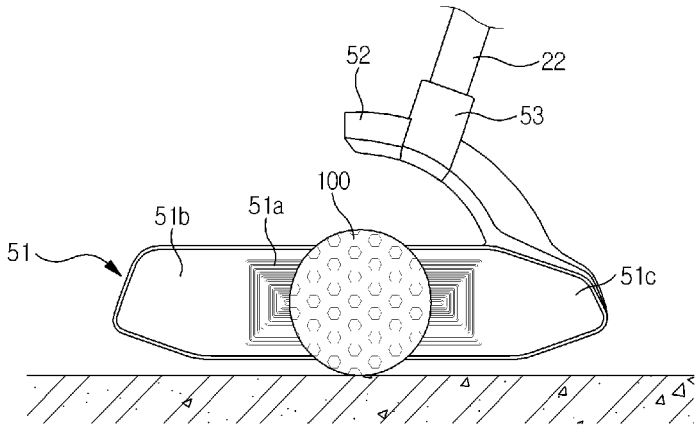
FIG. 9 is a front view illustrating a use state of the putter according to the embodiment of the present invention.
Figure 10:
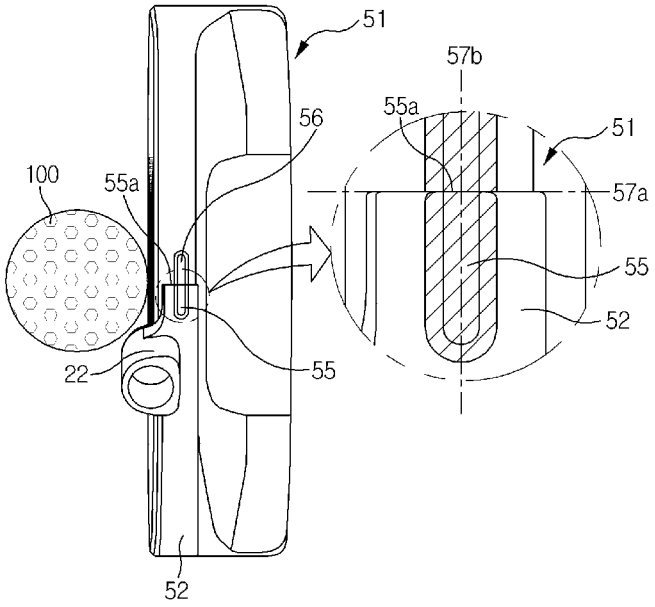
FIG. 10 is a plane view of FIG. 9.
Figure 11:
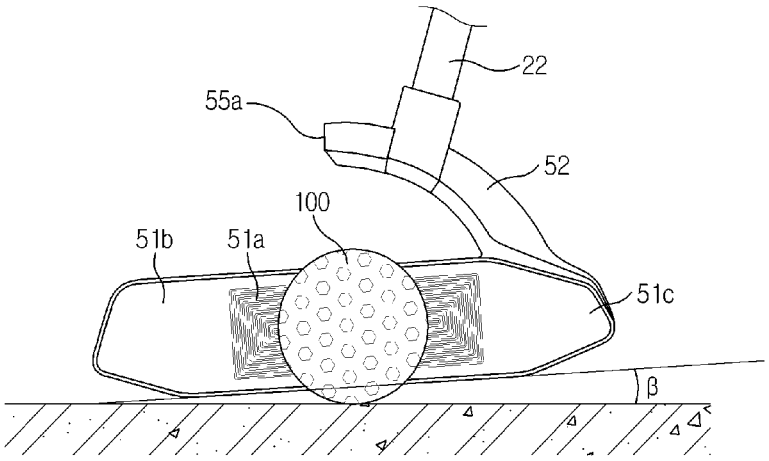
FIG. 11 is a front view illustrating a state in which a shaft of the putter according to the embodiment of the present invention is inclined outward of a golfer's body so that a heel portion of a putter head is spaced apart from the ground.
Figure 12:
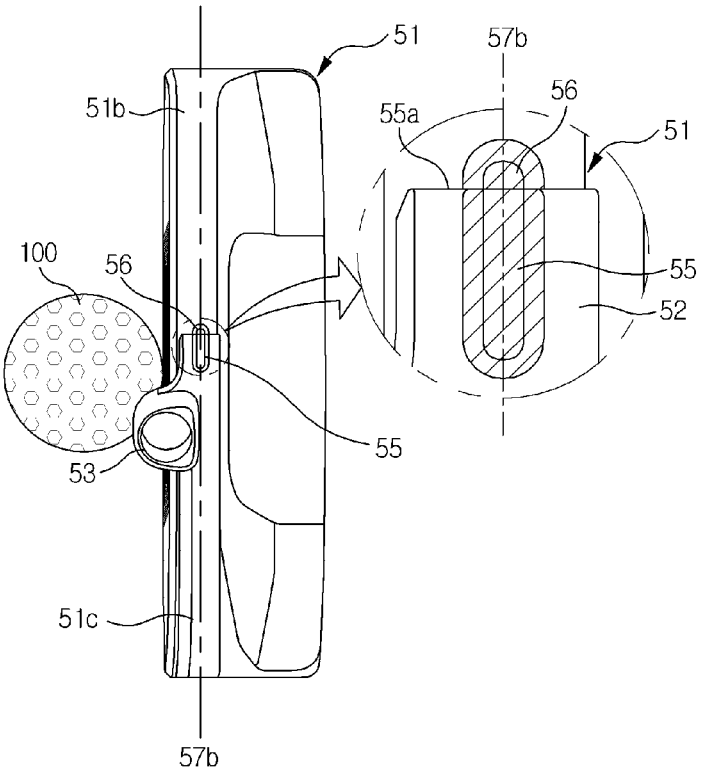
FIG. 12 is a plane view of FIG. 11.

Accordingly, a line CGL passing a center of gravity of the putter head 12 is naturally located at the center of the putter head 12. The center line of gravity is indicated by reference numeral CGL and coincides with a swing line during putting (see FIG. 2).

The neck 52 extends forward of the hosel 53. Therefore, force, namely, kinetic energy generated by swing of the putter head 51 toward the heel 51*c* or the toe 51*b* during impact of the putter is distributed so that the putter head 51 is prevented from rotating.

An end line 55*a* of the neck 52 is located on the swing line passing the central point CG of the putter head 51. An upper surface of the neck 52 is formed with a neck indication groove 55 which extends in a direction of the heel 51*c* from the end line 55*a* of the neck 52.

In addition, the putter head 51 is formed with a first putter head indication groove 56 which extends in a direction of the toe 51*b* from a vertical projection line of the end line 55*a* of the neck 52 projected to the putter head 51 such that the neck indication groove 55 coincides with a horizontal line 57*a* and vertical line 57*b* as imaginary lines.

As such, by forming the linear-shaped neck indication groove 55 and first putter head indication groove 56 coinciding with the swing line of the putter head 51, a golfer putts the ball after visually ascertaining whether the two linear-shaped grooves 55 and 56, the horizontal line 57*a*, and the vertical line 57*b* coincide with each other by a golfer's own eye during putting.

Figure 13:
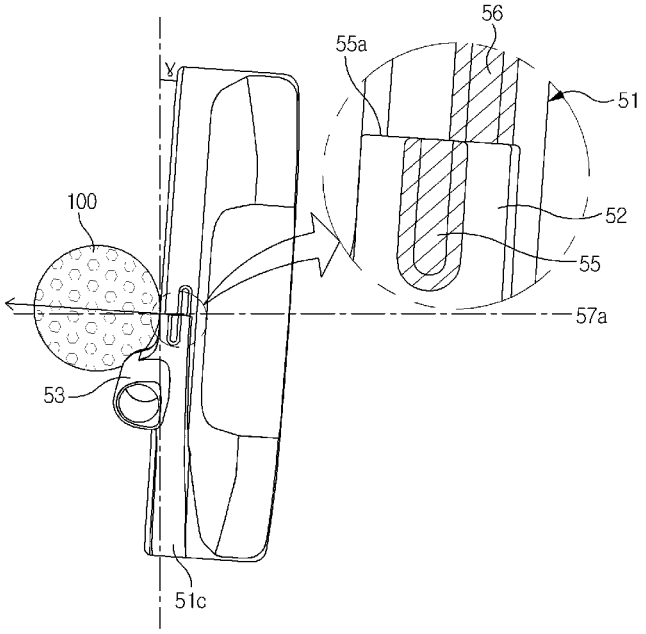
FIG. 13 a plane view illustrating a state in which a toe portion of the putter according to the embodiment of the present invention is inclined toward the right of a golfer so that a face of the putter head is not square relative to a ball.

When the two grooves do not coincide with each other, the golfer putts the ball in a state in which the putter head 51 is inclined in a forward and backward direction of the golfer with respect to the ground (see FIGS. 11 and 12) or in a state in which the putter head 51 is inclined in a left and right direction of the golfer with respect to the ground (see FIG. 13). Thus, the golfer may not send the ball along a desired putting line.

Figure 14:
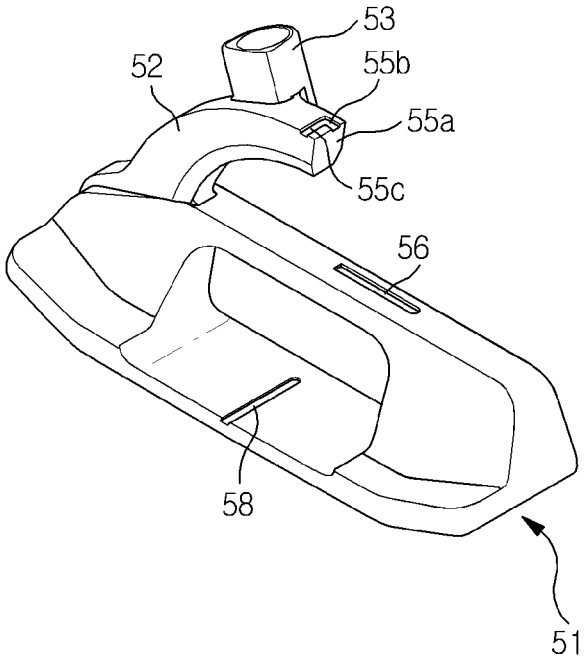
FIG. 14 is a front view illustrating a putter according to another embodiment of the present invention.
Figure 15:
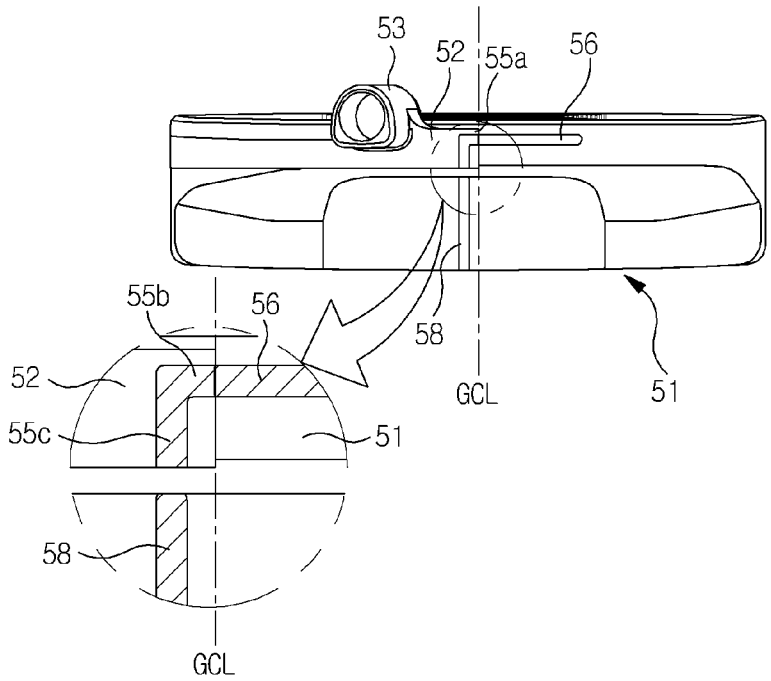
FIG. 15 is a plane view of FIG. 14.

FIGS. 14 and 15 show a putter according to another embodiment of the present invention. Unlike the above embodiment, the present embodiment is configured such that the neck indication portion 55 has a "ㄴ" shape configured to have a vertical indication portion 55*b* and a horizontal indication portion 55*c*, an end line of the vertical indication portion 55*b* coincides with the end line 55*a* of the neck 52, and the putter head 51 is additionally formed with a second putter head indication portion 58, which coincides with a line of the horizontal indication portion 55, to the right of the golfer. When a lower surface of the putter head is parallel with the ground and a face of the head is square relative to the ball, an end line of the second putter head indication portion 58 is parallel with the end line of the horizontal indication portion 55*c*.

The second putter head indication portion 58 helps the golfer to arrange the putter head in parallel with the ground.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A golf putter comprising:

a putter head (51);

a neck (52) formed on a radial line of curvature of a central point of the putter head (51), spaced apart from an upper surface of a toe (51*b*) of the putter head (51), and integrally connected to a heel (51*c*) of the putter head (51); and a hosel (53) formed at the neck (52) to insert a putter shaft (22) and configured such that a lower end extension line of the putter shaft (22) is directed toward the central point of the putter head (51) while being inclined toward a golfer's body with respect to a vertical line, wherein:

an end line (55*a*) of the neck (52) is located on a swing line (CGL) passing a central point (CG) of the putter head (51);

an upper surface of the neck (52) is formed with a neck indication portion (55) extending in a direction of the heel (51*c*) from the end line (55*a*) of the neck (52); and the putter head (51) is formed with a first putter head indication portion (56) extending in a direction of the toe (51*b*) from a vertical projection line of the end line (55*a*) of the neck (52) projected to the putter head (51) such that the neck indication portion (55) coincides with a horizontal line (57*a*) and vertical line (57*b*) as imaginary lines;

wherein the neck indication portion (55) has a vertical indication portion (55*b*) and a horizontal indication portion (55*c*) which are both linear-shaped and perpendicularly connected to each other, the vertical portion (55*b*) being parallel with the first putter head indication portion (56), an end line of the vertical indication portion (55*b*) coincides with the end line (55*a*) of the neck (52) and an other end line of the vertical indication portion (55*b*) being perpendicularly connected to an end line of the horizontal indication portion (55*c*), and the putter head (51) is additionally formed with a second putter head indication portion (58) being parallel with a line of the horizontal indication portion (55*c*) to the right of the golfer.

* * * * *